US006255927B1

(12) United States Patent
Fischer et al.

(10) Patent No.: US 6,255,927 B1
(45) Date of Patent: Jul. 3, 2001

(54) CABLE LUG CONDUCTOR ADAPTER DEVICE

(75) Inventors: Kenneth Martin Fischer, Finleyville; James Russell Everett, Midland, both of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/570,649

(22) Filed: May 15, 2000

(51) Int. Cl.[7] ..... H01H 9/02
(52) U.S. Cl. ..... 335/202; 439/810
(58) Field of Search ..... 335/167–176, 335/202; 200/293–308; 439/801–815

(56) References Cited

U.S. PATENT DOCUMENTS 3,133,779 * 5/1964 Stanback ..... 439/814
4,329,010 * 5/1982 Balch ..... 439/814
4,934,948 * 6/1990 Mune et al. ..... 439/217
5,772,479 * 6/1998 Fleege et al. ..... 335/202

FOREIGN PATENT DOCUMENTS

0337332 * 4/1989 (EP) .

* cited by examiner

*Primary Examiner*—Lincoln Donovan
(74) *Attorney, Agent, or Firm*—Martin J. Moran

(57) ABSTRACT

A cable lug conductor adapter for connecting to a circuit breaker bus having two lug attachment openings and which is structured to engage ND sized lugs, which are larger than lugs having a first size, to a cable terminal having a single opening which is structured to engage a lug having a second size, where the adapter includes a planar member having three threaded openings. Two of the three openings are threaded and sized to engage a lug of the first size, and one the three openings is threaded and sized to engage a lug of the second size.

11 Claims, 3 Drawing Sheets

CABLE LUG CONDUCTOR ADAPTER DEVICE

BACKGROUND OF THE INVENTION

1. Field of the Invention

This invention relates to a cable lug conductor adapter device and, more specifically, to a cable lug conductor adapter device which allows a cable terminal having a single lug to be coupled to a circuit breaker having a bus with multiple cable lug attachment openings.

2. Background Information

Some circuit breakers provide a single attachment point for the line side and load side of the circuit breaker. The attachment point is generally a threaded opening in a bus connected to one of the main contacts. The line typically includes a cable terminal having a single opening which is attached to the breaker by a single lug. A cable terminal typically includes an elongated tab with an opening therethrough. The lug passes through the opening and is secured to the bus. Circuit breakers having single lug terminals are designed to handle a line carrying up to 800 amps.

New circuit breakers, such as the ND frame circuit breaker, disclosed in U.S. Pat. No. 5,341,191, are designed to carry 1200 amps. ND frame circuit breakers include multiple attachment points between the cable and the bus connected to the main contact. An ND frame circuit breaker include a terminal which is attached to the circuit breaker bus. This terminal includes two attachment points between the terminal and the bus. The terminal also includes openings which are adapted to coupled with cables that do not have a terminal attached thereto, that is, a bare cable.

Prior circuit breakers may be replaced with the ND frame circuit breaker. The openings on the bus of an ND frame circuit breaker, however, are not structured to accept a cable having a terminal attached thereto. Typically, the two fastener openings on the ND circuit breaker bus are located proximal to a sidewall in the circuit breaker. The cable terminal elongated tab is large to be coupled to a opening that is proximal to a circuit breaker sidewall. There is, therefore, a need for an adapter device which allows a cable terminal from a prior circuit breaker to be coupled to an ND frame circuit breaker bus.

SUMMARY OF THE INVENTION

These needs and others are satisfied by the invention which is directed to a cable lug conductor adapter device which is structured to allow a prior frame circuit breaker cable having a terminal to be coupled to an ND frame circuit breaker bus.

The adapter device includes a conductive member having three openings therethrough. Two of the openings are sized to engage a lug of a first size which is smaller than an ND sized breaker lug. The two first sized openings are positioned to align with the threaded openings on a ND frame circuit breaker bus. A single opening is sized to engage a second sized lug. In operation, two lugs of the first size are passed through the ND frame circuit breaker bus and coupled to the adapter device. The remaining opening is coupled to a lug the second size which is also passed through a cable terminal attached to the line-in or load line. The cable terminal is structured to be coupled with a lug of the second size.

The member may be structured to be coupled to the ND frame circuit breaker bus through openings in the Circuit breaker housing or within the bus chambers within the housing.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
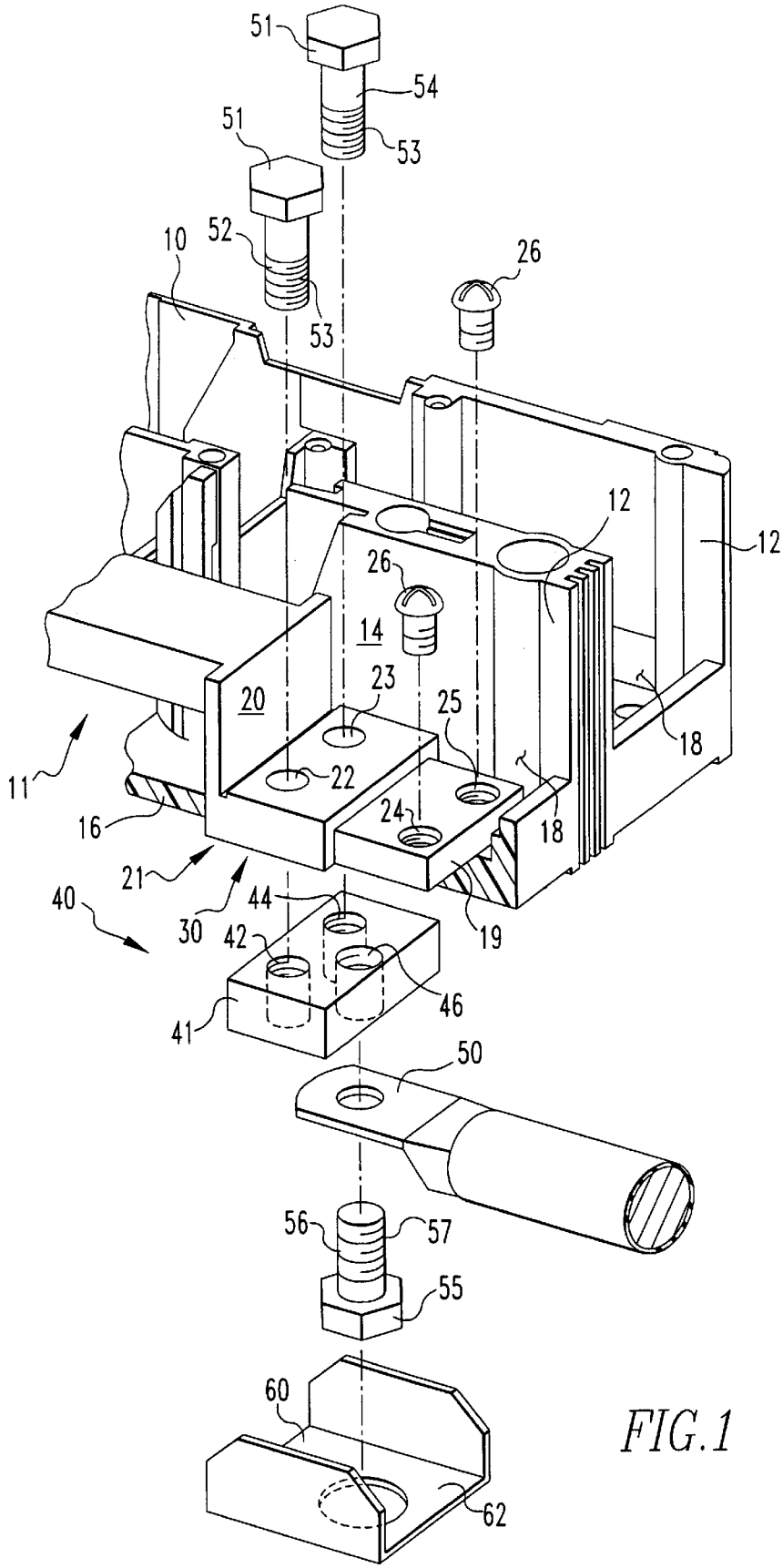
FIG. 1 is an isometric view of an adapter according to the present invention.

A circuit breaker housing 10 and an adapter assembly according to the present invention are shown in FIG. 1. The circuit breaker housing 10 includes a plurality of bus chambers 12. The chambers 12 include sidewalls 14 and bottom wall 16. The chambers 12 further include an exterior opening 18. A bus 20 is partially disposed in chamber 12. The bus 20 is in electrical communication with one of the main contacts (not shown) of the circuit breaker. A typical circuit breaker 10 may have more than one main contact with a corresponding bus 20. The bus 20 has a first side 19 and a second side 21 and includes two sets of openings 22, 23 and 24, 25. One set of openings 22, 23 is structured to accept a ND sized lug. An ND sized lug typically has a diameter of about ⅝ inch, which is larger than lug 52, 54 (described below) having a first size. The second set of openings 24, 25 are structured to cooperate with fasteners 26, which attach the bus 20 to the housing 10. Bottom wall 16 includes an opening 30 which is sized to accept an adapter device 40 (described below).

The adapter assembly 11 includes an adapter device 40, two cable lugs of the first size 52, 54 and a cable lug of the second size 56 and a non-conductive shield member 60. The two first size cable lugs 52, 54 each have a head 51 and a body 53. The first sized cable lugs bodies 53 preferably have a diameter of less than ⅝ inch and more preferably ½ inch. The second sized cable lug 56 also has a head 55 and a body 57. The second sized cable lug body 57 has a diameter of about ⅝ inch. The shield member 60 may include a fastener opening 62 sized to create an interference fit about lug head 55.

The adapter device 40 includes a planar member 41 constructed of a conductive material, such as copper, and includes three openings 42, 44, 46. Two openings 42, 44 arc positioned to align with the bus openings 22. Openings 42, 44 are threaded and are sized to engage a cable lug of the first size 52, 54. The third opening 46 is also threaded and is sized to engage a cable lug of the second size 56. The third opening 46 is structured so that, when the adapter device 40 is coupled to bus 20, the third opening 46 is not proximal to a sidewall 14. Preferably, the third opening 46 is laterally, centrally located on adapter device 40.

When assembled, adapter device 40 is disposed within exterior opening 30. Two lugs of the first size 52, 54 are passed through the first side 19 of the bus 20 into the openings 22, 23 and into adapter the device 40 and threaded into the openings 42, 44. A cable, terminating in a single hole cable lug terminal 50, is disposed adjacent to adapter device 40. The cable lug terminal has an elongated body with an opening therethrough. The opening is sized to allow a lug of the second size 56 to pass therethrough. A single cable lug of the second size 56 is passed through the cable lug terminal 50 and engaged with the adapter device opening 46. A shield device 60 having an opening 62 is disposed over the adapter device 40 and held in place by an interference fit between opening 62 and the lug head 55. When so configured, the adapter device 40 allows a cable having a cable terminal to be mated to a bus 20 having openings 22, 23 structured to accept ND sized lugs.

Figure 2:
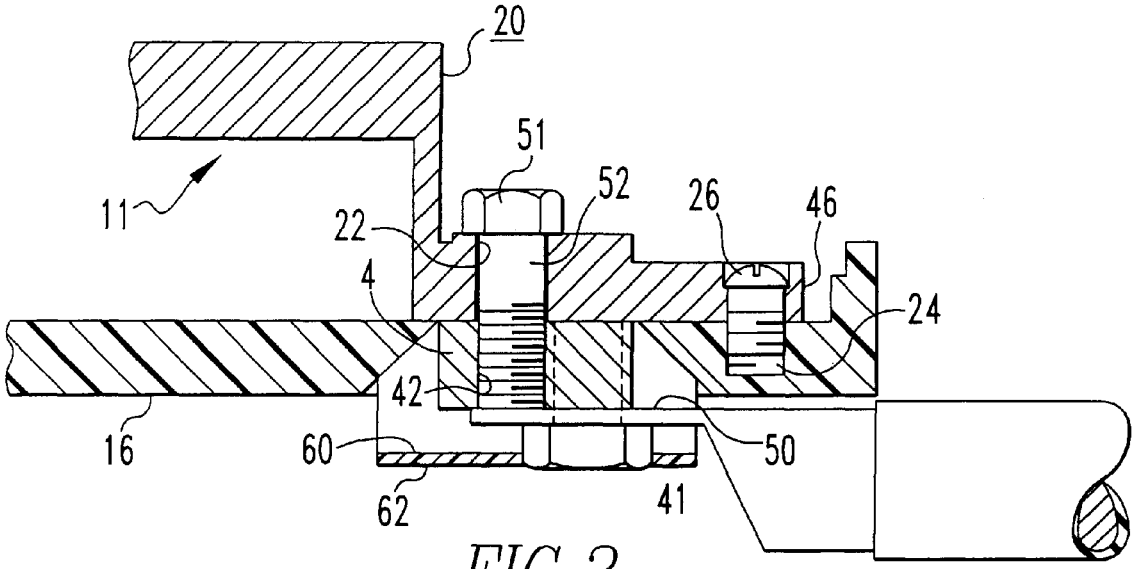
FIG. 2 is a cross-sectional view of the adapter.
Figure 4:
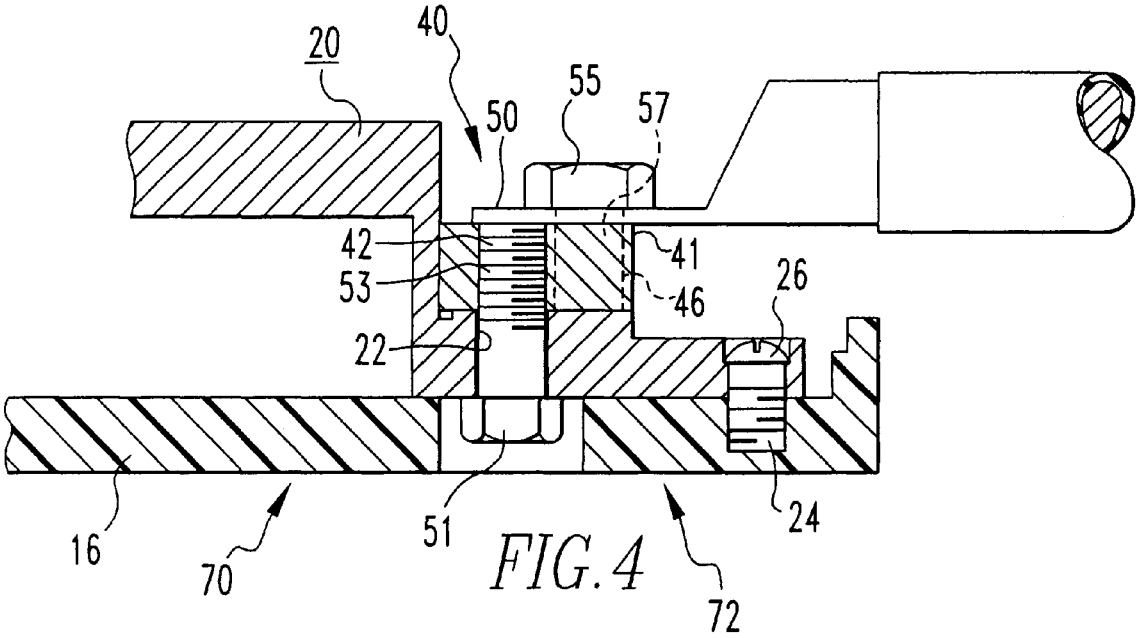
FIG. 4 is a cross-sectional view of the other embodiment of the adapter.
Figure 3:
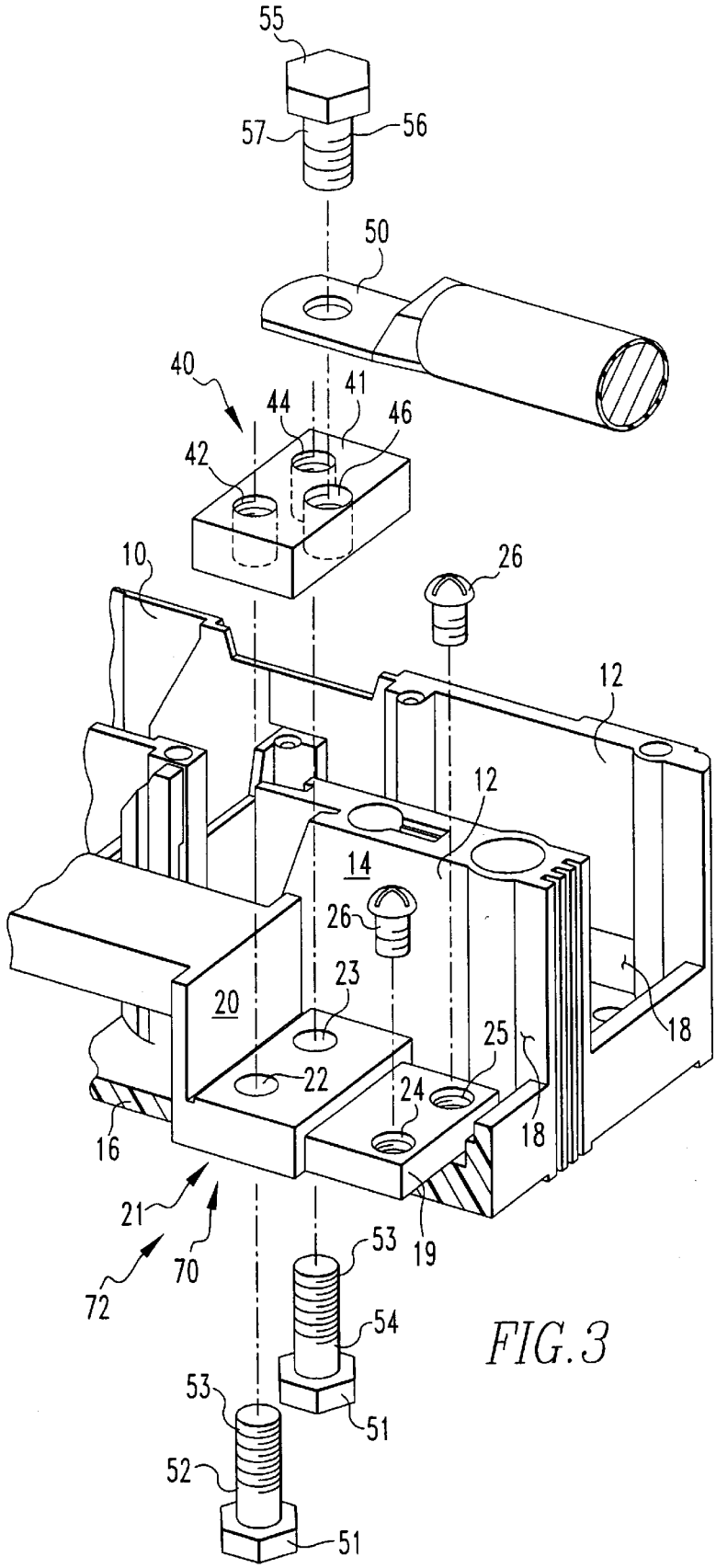
FIG. 3 is an isometric view of another embodiment of the present invention.

As shown in FIG. 2, the adapter device 40 may be disposed within a chamber 12 of the circuit breaker housing 10. In this configuration, the bottom wall 16 does not include an opening 30. Instead, two fastener openings 70, 72 pass through the bottom wall 16 and are aligned with the fastener openings 22, 23 in the bus 20. The remaining components remain configured as above. When assembled, adapter 40 is disposed within the chamber 12 on top of the bus 20, first sized lugs 52, 54 pass through openings 70, 72 and 22, 23 and are engaged with the adapter device openings 42, 44. Again, a cable with a single opening cable terminal 50 is provided. A lug of the second size 56 passes through the cable terminal 50 into adapter device 40 and engages with the second sized opening 46.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A cable lug conductor adapter for connecting a cable terminal to a circuit breaker bus, said circuit breaker bus having two lug openings, wherein said circuit breaker bus lug openings are larger than lugs of a first size, said cable terminal having a single opening which is threaded and sized to engage a lug having a second size, said adapter comprising:

a planar member having three threaded openings;

two of said three openings threaded and sized to engage a lug of said first size; and, one said three openings threaded and sized to engage a lug of said second size.

2. An adapter assembly for connecting a cable terminal to a circuit breaker bus, said circuit breaker bus having two lug openings, said circuit breaker bus lug openings are larger than lugs having a first size, said cable terminal having a single opening which is threaded and sized to engage a lug having a second size, said circuit breaker bus disposed within a circuit breaker housing, said adapter assembly comprising:

a member having three openings;

two lugs of a first size;

one lug of a second size;

two of said three openings threaded and sized to engage lugs of the first size; and, one of said three openings threaded and sized to engage a lug of the second size.

3. The adapter assembly of claim 2, wherein said one of three openings is laterally, centrally located on said member.

4. The adapter assembly of claim 2, wherein said assembly includes a non-conductive shield;

said shield having an opening sized to create an interference fit with said lug of a second size.

5. The adapter assembly of claim 4, wherein said circuit breaker housing has at least one bus chamber and wherein said adapter assembly is sized to fit within said chamber.

6. The adapter assembly of claim 4, wherein said circuit breaker housing has at least one bus chamber having a bottom wall, said bus disposed within said bus chamber, said housing having an opening on said bottom wall adjacent to said bus, wherein said member is disposed within said opening.

7. A circuit breaker comprising:

a housing;

a bus having two lug openings;

an adapter assembly comprising:

a member having three openings;

two lugs of a first size, said first size lugs being smaller than said bus lug openings;

one lug of a second size;

two of said three openings threaded and sized to engage lugs of the first size; and, one of said three openings threaded and sized to engage a lug of the second size.

8. The circuit breaker of claim 7, wherein said one of three openings is laterally, centrally located on said member.

9. The circuit breaker of claim 7, wherein said adapter assembly includes a non-conductive shield;

said shield having an opening sized to create an interference fit with said lug of a second size.

10. The circuit breaker of claim 9, wherein:

said circuit breaker housing has at least one bus chamber;

said bus partially disposed within said bus chamber;

said adapter assembly is sized to fit within said chamber; and, said two first sized lugs passing through said member and engaging said bus openings.

11. The circuit breaker of claim 10, wherein:

said circuit breaker housing has at least one bus chamber having a bottom wall;

said bus disposed within said bus chamber;

said housing having an opening on said bottom wall adjacent to said bus;

said member is disposed within said opening; and, said two first sized lugs passing through said member and engaging said bus openings.

* * * * *